United States Patent [19]

de la Burde et al.

[11] 4,243,056

[45] Jan. 6, 1981

[54] METHOD FOR UNIFORM INCORPORATION OF ADDITIVES INTO TOBACCO

[75] Inventors: Roger Z. de la Burde, Powhatan; Patrick E. Aument, Richmond, both of Va.

[73] Assignee: Philip Morris Incorporated, New York, N.Y.

[21] Appl. No.: 2,981

[22] Filed: Jan. 12, 1979

[51] Int. Cl.[3] ..... A24B 3/18; A24B 3/12; A24B 3/00

[52] U.S. Cl. ..... 131/140 B; 131/140 P

[58] Field of Search ..... 131/140 P, 144, 17 R, 131/143

[56] References Cited

FOREIGN PATENT DOCUMENTS 1106468 3/1968 United Kingdom ..... 131/144

*Primary Examiner*—V. Millin

*Attorney, Agent, or Firm*—Watson, Leavenworth, Kelton & Taggart

[57] ABSTRACT

A method for uniformly impregnating tobacco with additives, particularly flavoring agents, is disclosed. The method comprises contacting tobacco with liquid carbon dioxide having dispersed therein a flavoring agent or other additive; exposing the liquid carbon dioxide absorbed by the tobacco to conditions whereby it is converted to solid carbon dioxide; and thereafter allowing the solid carbon dioxide to evaporate. When the solid carbon dioxide is caused to vaporize rapidly, for example, by means of heat, the disclosed method will simultaneously impregnate tobacco with an additive and expand tobacco.

10 Claims, No Drawings

METHOD FOR UNIFORM INCORPORATION OF ADDITIVES INTO TOBACCO

BACKGROUND OF THE INVENTION

Many methods have been suggested for enhancing the quality of tobacco filler material. These methods have included expansion of tobacco filler to increase the filling power of the tobacco and thereby reduce the delivery of tar and nicotine relative to a product made with unexpanded tobacco. In addition, methods have been proposed for preferentially changing the pyrolytic and flavor characteristics of smoking tobacco products, both by removal and by addition of various agents to tobacco.

The processes proposed for expanding tobacco have included incorporation of various agents into the tobacco. For example, tobacco has been contacted with a gas under somewhat greater than atmospheric pressure, whereby the tobacco cells are expanded. Other expansion methods which have been employed or suggested have included impregnation of tobacco with various liquids, which are driven off to expand the tobacco. Further, treatment of tobacco with solid materials which, when heated, decompose to produce gases which serve to expand the tobacco has been suggested. Still other methods of tobacco expansion have included treatment of tobacco with gas-containing liquids, such as carbon dioxide-containing water, under pressure followed by heating or pressure reduction. Treatment of tobacco with gases which react to form solid chemical reaction products within the tobacco, which may be then decomposed by heat to produce gases within the tobacco is another technique which has been developed for expansion of tobacco. In many of these methods, carbon dioxide has been employed as an expansion agent. More specifically:

In U.S. Pat. No. 1,789,435 to Hawkins, tobacco is expanded by contact with a gas, which may be air, carbon dioxide or steam under about 20 pounds of pressure. Thereafter, the pressure is released whereupon the gas which has penetrated the tobacco expands tending to increase the volume of the tobacco.

According to the method of British Pat. No. 1,331,640, tobacco is impregnated with a non-gaseous compound capable of liberating a gas, such as carbon dioxide, oxygen or ammonia, upon thermal decomposition. Preferred compounds are said to be those which decompose at relatively low temperature, including ammonium carbonates, ammonium carbamates, organic dicarboxylic acids and peroxides.

South African applications Nos. 70/8291 and 70/8292 to R. J. Reynolds Tobacco Company, both filed in 1970, relate to tobacco expansion with chemical compounds which decompose to form a gas or with inert solutions of a gas, under pressure to maintain the gas in solution until it impregnates the tobacco.

A patent to Robert G. Armstrong et al., U.S. Pat. No. 3,771,533 which is assigned to the same assignee as the assignee of the present invention, involves treatment of tobacco with carbon dioxide and ammonia gases whereby the tobacco is saturated with these gases and ammonium carbonate is formed in situ. The ammonium carbonate is thereafter decomposed by heat to release the gases within the tobacco cells and to cause expansion of the tobacco.

In copending U.S. Patent Application Ser. No. 891,468 to de la Burde et al., assigned to the same assignee as the instant application, a process for expanding tobacco is described comprising the steps of (1) impregnating tobacco with gaseous carbon dioxide under pressure of at least about 250 psig and at sufficient temperature that substantially all of the carbon dioxide is maintained in gaseous form, (2) decreasing the pressure on the carbon dioxide-impregnated tobacco and (3) heating the impregnated tobacco under conditions effective to liberate the carbon dioxide therein so as to cause expansion of the tobacco. Copending U.S. Application Serial No. 891,290 to Utsch and assigned to the same assignee as the instant application describes an improvement in this last process which comprises cooling the gaseous carbon dioxide and tobacco system in step (1) above to a temperature close to the saturation temperature of carbon dioxide but not lower than −23° C. The conditions during this cooling are such that the carbon dioxide is not condensed to any significant degree, but rather remains substantially in the gaseous state.

Application Ser. No. 951,072 to Aument et al. filed on Oct. 13, 1978 and assigned to the same assignee as the instant invention, describes a process for impregnating tobacco with carbon dioxide which comprises: (a) contacting tobacco with carbon dioxide gas at relatively low pressure, (b) rapidly cooling the tobacco-carbon dioxide system until the carbon dioxide condenses and solidifies within the tobacco, and (c) releasing the pressure in the cooled system. Thereafter, the carbon dioxide-treated tobacco is expanded conventionally, such as by subjecting it to heating conditions effective to liberate the carbon dioxide therein.

Expansion of tobacco, using liquid carbon dioxide is described in Belgium Pat. No. 821,568, which corresponds to U.S. Application Ser. No. 441,767 to de la Burde and Aument and is assigned to the same assignee as the present application and in Belgium Pat. No. 825,133 to Airco, Inc. This process may be described as a process for expanding tobacco comprising the steps of (1) contacting the tobacco with liquid carbon dioxide ($CO_2$) to impregnate the tobacco with the liquid carbon dioxide, (2) subjecting the liquid carbon dioxide-impregnated tobacco to conditions such that the liquid carbon dioxide is converted to solid carbon dioxide and (3) thereafter subjecting the solid carbon dioxide-containing tobacco to conditions whereby the solid carbon dioxide is vaporized to cause expansion of the tobacco.

A series of patents to Roger Z. de la Burde, U.S. Pat. Nos. 3,409,022, 3,409,023, 3,409,027 and 3,409,028, granted in 1968, relate to various processes for enhancing the utility of tobacco stems for use in smoking products by subjecting the stems to expansion operations utilizing various types of heat treatment or microwave energy.

In addition to its use as an expansion agent, carbon dioxide has also been used in the food industry as a coolant and, more recently, has been suggested as an extractant for food flavors. It has also been described in German Offenlegungsschrift No. 2,142,205 (Anmeldetag; August 23, 1971) for use, in either gaseous or liquid form, to extract aromatic materials from tobacco.

None of the above art, involving the use of carbon dioxide suggests its use as a means for uniformly incorporating additives, such as flavoring agents, into tobacco. Moreover, although a number of methods have been suggested for incorporating additives having a beneficial effect on the organoleptic properties of smoking tobacco products, none of these methods involve the use of carbon dioxide.

Such additives have commonly been materials which themselves flavor the product or materials which release flavorant agents upon pyrolysis. Such materials have included the 1-menthyl carbonate esters of various alcohols disclosed by Bavley et al. in U.S. Pat. No. 3,312,226, mixed carbonate esters of a flavorant and a polyhydroxy compound disclosed in Mold et al., U.S. Pat. Nos. 3,419,543 and 3,332,428 and Kalinanos et al., U.S. Pat. No. 3,449,452 and polymeric carbonate esters disclosed by Rundberg, Jr. et al. in U.S. Pat. No. 3,887,603 and by Van Auken et al. in copending U.S. applications, Ser. Nos. 728,729 filed Oct. 1, 1976, now U.S. Pat. No. 4,119,106 and 859,712, as well as many others.

Incorporation of flavorants or flavorant release agents into tobacco has typically been accomplished by dissolving the flavorant or agent in a suitable solvent. The solution of flavorant material is thereupon sprayed on the tobacco or injected into the tobacco matrix. The solvent selected depends on the particular flavorant material employed. Solvents have included water and various organic materials, such as alcohol, acetone or cyclohexane.

Flavorant materials have also been admixed with tobacco material in solid form. This may be accomplished, for example, by admixing the solid dry material directly with the components of reconstituted tobacco sheet prior to forming the sheet. Alternatively, flavorant material, encapsulated according to the method proposed in McGlumphy U.S. Pat. No. 3,550,598, has been incorporated into tobacco material using conventional techniques. For example, an aqueous slurry of such capsules may be sprayed onto tobacco. Adhesives or binders may be employed to bind the capsules to the filler.

A patent to John D. Hind, U.S. Pat. No. 3,425,425, granted in 1969, which is assigned to the same assignee as the assignee of the present invention, relates to the use of carbohydrates to improve the puffing of tobacco stems. In that process, tobacco stems are soaked in an aqueous solution of carbohydrates and then heated to puff the stems. According to the patent, the carbohydrate solution may also contain organic acids and/or certain salts which are used to improve the flavor and smoking qualities of the stems.

These previously employed techniques for incorporating additives for enhancing organoleptic properties of smoking tobacco products have not been found to be completely satisfactory. Distribution of additives on the tobacco fibers may often be uneven, and more importantly, full penetration of the added substances into the cellular structure may not be achieved. Removal of residual solvent is often a problem. Morever, where the tobacco material being altered has been expanded and the flavorant agent is added as a spray after expansion, collapse of the tobacco toward the unexpanded state may result.

Unexpectedly, it has been discovered that flavorant addition can be satisfactorily effected by means of the method described herein. The flavorant is uniformly distributed in tobacco material with full penetration into the cellular structure when the instant method is employed. Moreover, the present method not only avoids the disadvantages encountered in flavorant addition to expanded product, but, in fact, allows addition of flavorant and an expansion agent to be accomplished in a single step.

SUMMARY OF THE INVENTION

This invention relates to a method for uniformly incorporating an additive into tobacco. The method comprises (a) dispersing the additive in liquid $CO_2$; (b) contacting tobacco with the resultant liquid $CO_2$ solution; (c) converting liquid carbon dioxide absorbed during step (b) to solid carbon dioxide; and (d) thereafter allowing the solid carbon dioxide to evaporate. Expansion of the tobacco is simultaneously accomplished when the solid carbon dioxide is rapidly vaporized.

DETAILED DESCRIPTION OF THE INVENTION

This invention relates generally to an improved method for incorporating additives, such as flavorants, into tobacco. By means of the method of the invention, materials may be uniformly impregnated in the tobacco structure. Furthermore, expansion of the tobacco and impregnation with the additives may be accomplished in a single process.

The method of the invention broadly comprises contacting tobacco with a solution of liquid carbon dioxide and an additive, solidifying the liquid carbon dioxide absorbed by the tobacco and thereafter allowing the solid carbon dioxide to evaporate. Under appropriate conditions, the tobacco may also be expanded as a result of this process.

More particularly, an additive, such as a flavoring agent or burn additive is dispersed in liquid carbon dioxide. Tobacco material is contacted with the solution thus formed for a period of time sufficient to permit absorption of the resultant solution by the tobacco. During this contacting step, the conditions of the process should be such that the carbon dioxide remains partially in a liquid state and the additive remains substantially dissolved therein. The solution impregnated tobacco is then subjected to conditions such that the liquid carbon dioxide is converted to solid carbon dioxide. For example, this may be accomplished by impregnating the tobacco under pressure and thereafter rapidly releasing the pressure. The solid carbon dioxide-tobacco combination is then subjected to conditions which permit the carbon dioxide to evaporate. Under some conditions the vaporization of the carbon dioxide will simultaneously cause expansion of the tobacco. For example, when the combination is subjected to heat, radiant energy or similar energy generating conditions, which cause carbon dioxide to rapidly vaporize, some degree of expansion will be accomplished.

The process of the present invention may be used to treat either whole cured tobacco leaf, tobacco in cut or chopped form, or selected parts of tobacco, such as tobacco stems or reconstituted tobacco. In comminuted form, the tobacco to be treated may have a particle size of from about 10 to about 100 mesh, but is preferably not smaller than about 30 mesh.

The material to be treated may be in relatively dry form, or may contain the natural moisture content of tobacco or even more. Generally, the tobacco to be treated will have at least about 8% moisture (by weight) and less than about 35% moisture. An initial moisture content of from about 17% to about 25% is preferred since lower pressures may then be employed during the impregnation step.

As used herein, % moisture may be considered equivalent to (OV) since not more than about 0.9% of the tobacco weight is volatiles other than water. Oven volatiles determination is a simple measurement of weight loss on exposure in a circulating air oven for three hours at 100° C.

According to one specific embodiment, the tobacco, at the desired input moisture level, is placed in a pressure vessel in a manner whereby it can be suitably immersed or contacted by liquid carbon dioxide. For example, a wire cage or platform may be used.

The tobacco-containing pressure vessel may be purged with carbon dioxide gas or by vacuum, the purging operation generally taking from about 1 to 5 minutes. The purging step may be eliminated without detriment to the final product. The benefits of purging are the removal of gases that could interfere with a carbon dioxide recovery process and to flush out of the tobacco any foreign gases which might interfere with full penetration of the liquid carbon dioxide.

The liquid carbon dioxide which is employed in the process of this invention may be obtained from a storage vessel where it will, generally, be maintained at a pressure of from about 250 to 305 psig. The additives which may be employed in the practice of the present invention include both those which are soluble in and those which remain in a very fine suspension in liquid carbon dioxide. Such a suspension must be of particles not more than about 10 microns in diameter, and preferably less than 1 micron. For materials not soluble in carbon dioxide, the dispersion would most readily be formed by first grinding or otherwise comminuting solid materials and then dispersing them in liquid carbon dioxide in a pressurized mixer. Insoluble liquids could be dispersed by blending with liquid carbon dioxide and passing the blend through a pressurized homogenizer such as a throttling jet or similar device. Solutions for use in the invention are prepared in conventional fashion by agitating the solute with liquid carbon dioxide in a pressurized mixer. As used herein, references to dispersing additives in liquid carbon dioxide are intended to include both actual dissolution of additives and formation of fine suspensions of additives in the carbon dioxide; similarly, references to solutions are intended to encompass fine suspensions. The additives which may be employed in the practice of the invention include various flavoring agents, such as fruit concentrates and extracts, as well as some alcohols, esters, heterocyclic compounds and the like, now used in tobacco flavoring.

The amount of additive dispersed in the carbon dioxide will be dependent on a number of factors. For example, the nature of the particular additive and the degree to which the additive's property is to be imparted will affect the amount of additive. The solution concentration will be based on the ultimate concentration desired in the tobacco, the proposed excess of carbon dioxide over that to be entrapped, and possibly the limited solubility of the additive when the dispersion path is not being used.

The liquid carbon dioxide solution is introduced into the pressure vessel alone or with carbon dioxide gas until the pressure is raised to about 300–1,050 psig, preferably about 400 to 800 psig, and until the quantity of liquid carbon dioxide is sufficient to immerse the tobacco being treated. At the time the liquid carbon dioxide is introduced into the pressure vessel, the interior of the vessel, including the tobacco to be treated, should preferably be at a pressure at least sufficient to maintain the carbon dioxide in a liquid state. A much preferred procedure is to introduce the solution into the vessel after it has already been brought to or nearly to the operating pressure with carbon dioxide gas.

The liquid carbon dioxide solution is preferably introduced into the vessel in a manner which permits it to uniformly contact and saturate the tobacco in order to insure uniform absorption. Generally, this will comprise using about 2 to 10 parts by weight of liquid carbon dioxide solution per part of tobacco. Excess liquid carbon dioxide will be largely recovered before pressure reduction. The temperature of the carbon dioxide should not be permitted to exceed about 31° C., during this impregnation step.

The liquid carbon dioxide is permitted to contact the tobacco and preferably to saturate it. This generally requires a total period of from about ½ to 10 minutes and preferably from about 1 to about 5 minutes. Thereafter, excess liquid carbon dioxide which has not been absorbed by the tobacco mass is removed from the vessel as completely as draining from the tobacco permits. It is preferred that this step be accomplished while maintaining the conditions of temperature and pressure at the same levels as during the contacting step.

The excess liquid carbon dioxide may be removed from the tobacco mass, for example, by drainage through an exit port at the bottom of the chamber, while maintaining the pressure in the vessel. Typically, the draining will be continued until there is no longer a continuous flow of liquid. To insure complete removal of unabsorbed carbon dioxide, a second drain period after a brief waiting period may be employed. The excess liquid carbon dioxide solution may be recovered and reused.

After the impregnation, and preferably after draining and post-draining excess liquid carbon dioxide, the liquid carbon dioxide-impregnated tobacco is subjected to conditions such that the liquid carbon dioxide is wholly converted to solid or gaseous carbon dioxide. The carbon dioxide and additives are thereby solidified and intracellularly trapped in the tobacco. According to a preferred practice, the conversion of liquid carbon dioxide to solid carbon dioxide is accomplished by reducing the gas pressure of the system at a sufficiently rapid rate that at least a portion of the carbon dioxide within the tobacco is converted to solid.

The pressure reduction may be accomplished by venting the system to release the gases therein and bringing the contents of the vessel to atmospheric pressure. This venting generally takes from about ½ to 10 minutes, depending on size of vessel, but should preferably take no longer than 10 minutes. After venting, the temperature in the vessel should generally be from about −60° to −79° C. and the liquid carbon dioxide in the tobacco will be at least partially converted to solid carbon dioxide, and partially to gas. The pressure need not be reduced to atmospheric, but need only be reduced below about 60 psig. Obviously, this is not as preferable from a commercial viewpoint as reducing the pressure to atmospheric.

The tobacco, after the impregnation step, may be transported to a zone where it is subjected to conditions such that the carbon dioxide is removed from the tobacco. This can be accomplished by simply permitting evaporation of the solid carbon dioxide at ambient conditions. Alternatively, the solid carbon dioxide may be removed by exposing the solid carbon dioxide-impregnated tobacco to expansion conditions, such as exposure to heat or the equivalent, in order to rapidly remove the carbon dioxide and thereby cause expansion of the tobacco without loss of the deposited flavors and/or additives.

Expansion conditions may comprise the use of hot surfaces, or a stream of hot air, a mixture of gases and steam, or exposure to other energy sources, such as microwave energy or infrared radiation. It has been found that the use of a gas composition comprising at least 50% (by weight) of steam, and preferably above 80% (by weight) of steam, provides particularly satisfactory results. A convenient means of expanding the carbon dioxide-containing tobacco is to place it or to entrain it in a stream of heated gas, such as superheated steam or to place it in a turbulent air stream maintained, for example, at a temperature of from about 150° to about 260° C. (as low as 100° C. and as high as 370° C.) for a period of about 1 second to 10 minutes. The impregnated tobacco may also be heated by being placed on a moving belt and exposed to infrared heating, by exposure in a cyclone dryer, by contact in a tower with superheated steam or a mixture of steam and air or the like. Any such contacting steps should not raise the temperature of the atmosphere with which the tobacco is in contact to above about 370° C. and should preferably be from at about 100° to about 300° C., most preferably 150° to 260° C. when conducted at atmospheric pressure.

As is well known in the processing of any organic matter, overheating can cause damage, first to color, such as undue darkening, and finally, to the extent of charring. The necessary and sufficient temperature and exposure time for expansion without such damage is a function of these two variables as well as the state of subdivision of the tobacco. Thus, to avoid undesirable damage in the heating step, the impregnated tobacco should not be exposed to the higher temperature levels, e.g., 370° C., longer than 1 to 2 seconds.

One method for causing the expansion of the tobacco cells is to use the radiation methods described in either U.S. Pat. Nos. 3,409,022 or 3,409,027. In this operation, the tobacco never attains a temperature above about 140° C., being cooled by the rapid evolution of gases. The presence of steam during heating assists in obtaining optimum results.

Another system, usually preferred, is to use a dispersion dryer, for example, one that is supplied either with steam alone or in combination with air. An example of such a dryer is a Proctor & Schwartz PB dispersion dryer, usually referred to herein as a tower. The temperature in the dryer may range from about 120° to 370° C. with contact time in the dryer of about 1 to 10 seconds. In general, a 1 to 6 second contact time is utilized when the hot gas temperature is 260° to 315° C. or somewhat higher. As stated before, other known types of heating means may be used as long as they are capable of causing the impregnated tobacco to expand without excessive darkening. The presence of a steam atmosphere of 20% or more of the total hot gas composition aids in obtaining the best expansion; a high proportion (e.g., over 80% by weight) of steam is preferred.

As described herein, the degree of expansion is measured in terms of cylinder volume. Cylinder volume (CV) is determined as follows: Tobacco filler weighing 10.000 g is placed in a 3.358-cm diameter cylinder, vibrated for 30 seconds on a "Syntron" vibrator and compressed by a 1875-g piston 3.335-cm in diameter for 5 minutes and the resulting volume of filler is reported as cylinder volume. This test is carried out at standard environmental conditions of 23.9° C. and 60% RH; conventionally unless otherwise stated, the sample is preconditioned in this environment for 18 hours. The value depends on the moisture content (OV). In order to bring slightly different OV materials to a comparable basis, the CV value may be adjusted to some specified oven-volatile content, according to the following formula:

Corrected CV or $CCV=CV+F(OV-OV_s)$ where $OV_s$ is the specified OV and F is a correction factor (volume per %) predetermined for the particular type of tobacco filler being dealt with. CV and CCV are expressed in cc/10 grams. The method for cylinder volume measurement is described in Wakeham et al., "Filling Volume of Cut Tobacco and Cigarette Hardness," *Tobacco Science,* Volume XX, pages 157–160 (1976), the disclosures of which are incorporated herein by reference.

The present process may be conducted in various forms of apparatus. It is important that the apparatus in which the liquid carbon dioxide-containing tobacco is converted to solid carbon dioxide-containing tobacco be able to contain gases at the elevated pressures which may be employed, and preferably, as high as 1,500 psig or more. Preferably, the initial step of contacting the liquid carbon dioxide with the tobacco is conducted in such a pressure vessel.

There may be numerous arrangements of the pressure vessel. However, there should preferably be a valved inlet to permit introduction of the additive/liquid carbon dioxide solution and a valved outlet at the bottom of the vessel whereby liquid may be drained off; a second valved outlet near the top, for venting, may be added, and could be inserted as part of the inlet line, if desired, placed between the vessel and the inlet valve. A means of heating the vessel and/or the supply vessel, such as external heating coils, may be employed. Supporting the vessel on a load cell greatly simplifies measuring the carbon dioxide charge. A supplementary vessel similarly equipped with weighing means and heating coils is advantageous, though not essential, because it permits preheating a charge of liquid carbon dioxide from its usual low storage temperature of −20° C. (which may be about 215 psig). In operation, the filler may be placed in the main pressure vessel in a suitable holder such as a wire basket suspended above the bottom of the vessel. The closed vessel may then be purged with carbon dioxide gas and the outlets closed. The pressure is then raised to about 300–1050 psig by addition of carbon dioxide gas and carbon dioxide solution in an amount sufficient to cover all of the tobacco present in the vessel. The tobacco is soaked in the carbon dioxide solutions at the desired pressure and temperature, which should be less than 31° C. (the critical temperature of carbon dioxide) for about 1 to 20 minutes while impregnation takes place. Excess liquid carbon dioxide is then drained off by opening the lower outlet of the vessel to a suitable reservoir or the like disposal system, and when all excess liquid has been removed from the vessel, the vessel is vented to atmospheric pressure. The tobacco is then subjected to an operation to volatilize the solid carbon dioxide, preferably by removing the solid carbon dioxide-containing tobacco from the vessel and passing it through any of several rapid heating systems to achieve expansion. As indicated earlier in this specification, systems for this expansion process are most satisfactory which provide rapid, turbulent contact with the hot gas or vapor.

After the tobacco has been recovered from the flavor impregnation and/or expansion step, it is then, generally, equilibrated (reordered) at conditions which are well known in the trade. Reordering is preferably done at standard conditions, which generally involve maintaining the tobacco at a temperature of 23.9° C. and 60% RH for at least 18 hours. The impregnated, possibly expanded tobacco may then be incorporated in smoking tobacco products.

Specifically, a flavorant may be uniformly incorporated in tobacco and the tobacco filler may be simultaneously expanded as follows: Bright cut filler at 12% OV is impregnated at 800 psig with a $CO_2$ liquid solution of about 0.002% (20 ppm) of an apple flavor concentrate. After a soak time of 10 minutes, the excess liquid $CO_2$ is removed and the pressure is reduced to ambient conditions. During the pressure drop, the carbon dioxide solution solidifies and is entrapped inside the filler cells. Thus impregnated filler is then heated in a dryer tower in a steam atmosphere at 110° C. for 3 seconds. The impregnated and expanded tobacco may then by equilibrated and incorporated in tobacco products.

Tobacco filler may similarly be impregnated with one or more of the following additives: extracts of pineapple, orange and cherry and a mixture of alcohols and esters now used in tobacco flavoring, as described in Leffingwell et al., "Tobacco Flavoring for Smoking Products," R. J. Reynolds Tobacco Co. (1972).

Following the pattern described, the following Example illustrates the invention.

EXAMPLE

A portion of cut bright tobacco filler containing approximately 12% OV, weighing 25 g, was placed on a screen platform in a Parr bomb so that the tobacco did not rest on the bottom of the chamber. Approximately 1 g of benzaldehyde was placed in the bottom of the chamber and dry ice weighing about 80 g was added. The bomb was sealed and left to warm to melt the dry ice. The pressure reached 500 psig before the vent line was opened and the bomb was uncapped. The impregnated filler was passed through a small tower swept with steam at 300° C. and 130 ft/sec. The product was then equilibrated to standard conditions (24° C./60% r/h) in a cabinet.

The same procedure was followed with other portions of bright filler with menthol and with methyl salicylate as flavors. Two of the samples, after conditioning, were measured for cylinder volume and OV:

| | CV, cc/10 g | OV, % |
|---|---|---|
| benzaldehyde | 69 | 11.4 |
| methyl salicylate | 76 | 11.5 |
| control, untreated | 32 | 12 approximately |

Cigarettes were hand-made from each of the treated fillers. The fillers gave off the characteristic flavor, and the cigarettes, when smoked, clearly had the flavor of cherry (benzaldehyde), menthol, or wintergreen, respectively.

What is claimed is:

1. A method for uniform incorporation of additives into tobacco which comprises:

(a) dispersing an additive in liquid carbon dioxide;

(b) contacting tobacco with the resultant liquid carbon dioxide solution for a period of time sufficient to permit absorption of at least part of the solution by the tobacco;

(c) converting part of the liquid carbon dioxide absorbed by the tobacco to solid carbon dioxide; and (d) allowing the solid carbon dioxide to evaporate.

2. The method of claim 1 wherein unabsorbed carbon dioxide is removed prior to converting the liquid carbon dioxide to solid carbon dioxide.

3. The method of claim 1 wherein the step of contacting the tobacco is effected under about 300 to 1050 psig pressure and the liquid carbon dioxide is converted to solid carbon dioxide by rapidly reducing the pressure.

4. The method of claim 1 wherein the solid carbon dioxide is evaporated by means of heat.

5. The method of claim 1 wherein the additive is a flavoring agent.

6. A method for simultaneously incorporating an additive in and expanding tobacco which comprises:

(a) impregnating tobacco with an additive and carbon dioxide by contacting the tobacco with a liquid carbon dioxide solution comprising the additive dispersed in liquid carbon dioxide;

(b) subjecting the liquid carbon dioxide-impregnated tobacco to conditions such that part of the liquid carbon dioxide is converted to solid carbon dioxide; and (c) thereafter expanding the tobacco by rapidly vaporizing the solid carbon dioxide.

7. The method of claim 6 wherein unabsorbed carbon dioxide is removed prior to converting the liquid carbon dioxide to solid carbon dioxide.

8. The method of claim 6 wherein the tobacco is contacted with the liquid carbon dioxide solution under about 300 to 1050 psig pressure and liquid carbon dioxide is converted to solid carbon dioxide by reducing the pressure.

9. The method of claim 6 wherein the solid carbon dioxide is vaporized by means of heat.

10. The method of claim 6 wherein the additive is a flavoring agent.

* * * * *